United States Patent [19]

Stocklöw

[11] 4,233,693

[45] Nov. 18, 1980

[54] HEIGHT-ADJUSTABLE WASH-BASIN

[76] Inventor: Peter Stocklöw, Richard-Strauss-Strasse 12, 1000 Berlin 33, Fed. Rep. of Germany

[21] Appl. No.: 33,058

[22] Filed: Apr. 25, 1979

[30] Foreign Application Priority Data

Apr. 28, 1978 [DE] Fed. Rep. of Germany ..... 2819428

[51] Int. Cl.[3] ..... A47K 1/04; E03C 1/32

[52] U.S. Cl. ..... 4/644; 4/645; 4/653; 4/519

[58] Field of Search ..... 4/170, 107, 166, 169, 4/187 R, 187 A, 188

[56] References Cited

U.S. PATENT DOCUMENTS

| | | | |
|---|---|---|---|
| 1,320,553 | 11/1919 | Hominuk | 4/167 |
| 1,446,509 | 2/1923 | Koprowicz | 4/167 |
| 2,716,757 | 9/1955 | Eriksson | 4/166 |
| 2,746,664 | 5/1956 | Strmic | 4/167 X |
| 3,118,147 | 1/1964 | Larkin | 4/170 |
| 3,456,264 | 7/1969 | Flagg | 4/170 |
| 3,486,175 | 12/1969 | Schwartz | 4/170 |
| 4,158,898 | 6/1979 | Danhart | 4/170 |

*Primary Examiner*—Henry K. Artis
*Attorney, Agent, or Firm*—Haynes N. Johnson

[57] ABSTRACT

A height-adjustable washbasin is provided by the present invention. The basin is supported by at least one supporting arm which is pivotally mounted to a fixed surface at one end and received within the washbasin structure at the other end. An arresting element associated with the supporting arm is provided so that the supporting arm can be retained in a selected position, and a force reservoir such as a cylinder spring or gas pressure spring counter-balances the weight of the washbasin on the supporting arm. The height of the washbasin can be adjusted to the level desired by pivoting the supporting arm and securing it in place at the desired level.

14 Claims, 2 Drawing Figures

HEIGHT-ADJUSTABLE WASH-BASIN

DESCRIPTION

BACKGROUND OF THE INVENTION

The invention relates to a height-adjustable washbasin. Such a washbasin is suitable, for example, for adults, children and people confined to wheelchairs. Preferably it could be used in hotels and hospitals.

A known height-adjustable washbasin is disclosed in U.S. Pat. No. 3,486,175. However, the device disclosed in that patent is complicated and expensive. As such, repairs can be difficult to make. It is the object of the present invention to provide a simplified height-adjustable washbasin which is easy to use.

SUMMARY OF THE INVENTION

The present invention provides a simplified height-adjustable washbasin supported by a pivotal supporting arm. At one end, the arm is pivotally mounted to a wall or other object, and at the other end, the arm is received within the washbasin structure. Means for arresting the supporting arm in a selected position are provided. Such means can include a latch wheel mounted on the end of the arm received with the washbasin structure and a lever having a latch mounted proximate to the latch wheel so that the latch can selectively engage the latch wheel. When the latch and latch wheel are in engagement, the supporting arm is locked in place, but when they are not in engagement the supporting arm can be pivoted. A force reservoir such as a cylinder spring or gas pressure spring is provided to counterbalance the weight of the washbasin on the supporting arm. The position of the washbasin can be adjusted by releasing the means for arresting and then pivoting the supporting arm until the washbasin is at the desired height.

DETAILED DESCRIPTION OF THE DRAWINGS

Figure 1:
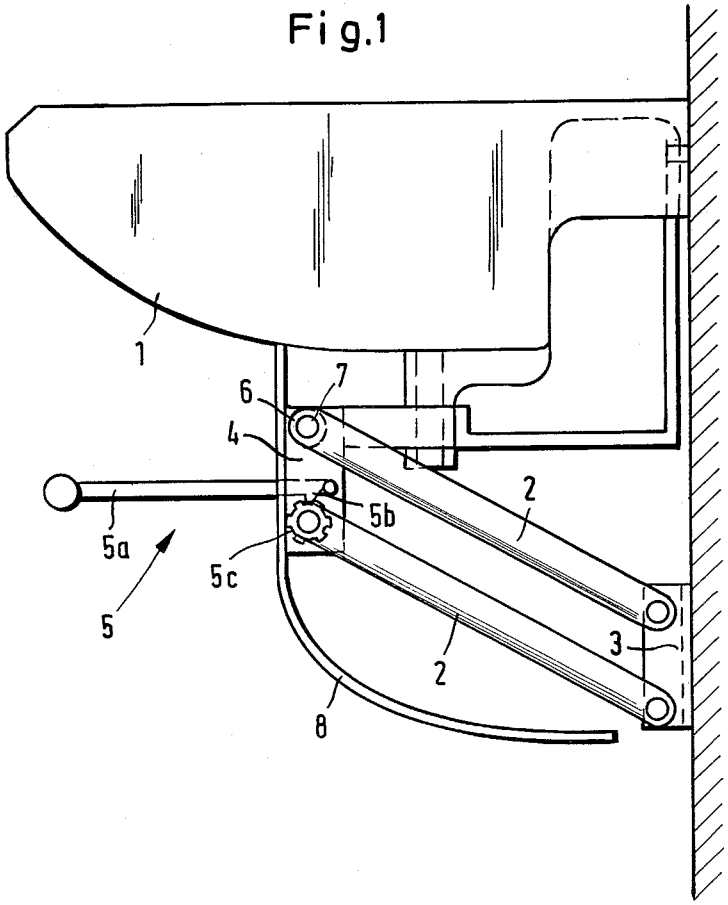
FIG. 1 shows a side elevational view of one embodiment of a height-adjustable washbasin in accordance with the present invention.

Referring to FIG. 1 of the drawings, a height-adjustable washbasin in accordance with the present invention is illustrated. The washbasin which is shown generally by numeral 1 has a downwardly extending portion shown as numeral 4. A pair of upper and lower supporting arms 2 is pivotally mounted at one end to a stationary piece 3 which is fixed to a wall. The other end of the arms 2 are received within the extension 4 of the washbasin. As shown in FIG. 1, the arms 2 are of equal length and parallel to each other and arms 2, extension 4, and stationary piece 3 form a parallelogram. The arms 2 are arranged in the vertically extending symmetry plane of the washbasin.

Figure 2:
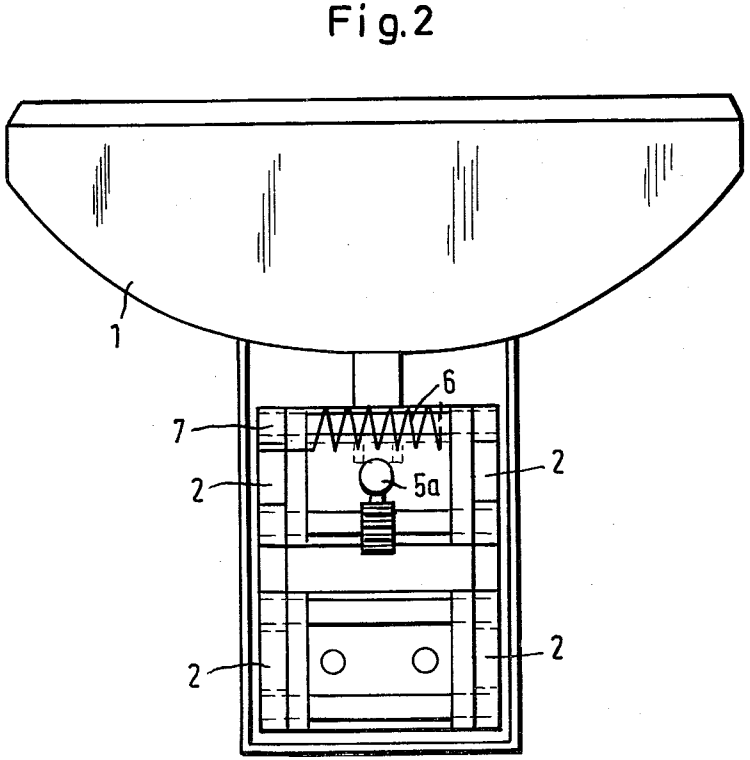
FIG. 2 shows the front elevational view of the washbasin of FIG. 1 with the shirt 8 omitted for purposes of clarity.

FIGS. 1 and 2 show that the lower arm 2 has a toothed latch wheel mounted to its end which is received in the extension 4. A latch mechanism shown generally as 5 includes a lever 5*a* having a latch 5*b* affixed to one end thereof. The lever is pivotally mounted to the extension 4 of the washbasin and it is positioned so that the latch 5*b* is proximate to the latch wheel 5*c*. The lever can be pivoted so that the latch can either engage or disengage the latch wheel at the end of the lower arm 2. When the latch engages the latch wheel, the washbasin is arrested at a certain height. When the latch is disengaged from the latch wheel, the lower arm 2, and thus the washbasin, is movable because arms 2 can be pivoted about piece 3 affixed to the wall. In the preferred embodiment, the arms 2 are sufficiently long so that horizontal movement of the washbasin is minimized when the arms 2 are pivoted. Also, as shown in FIG. 1, a shirt 8 is provided to cover the parts underneath the washbasin. The feed pipes and drain pipes (not shown) connected to the washbasin are formed from a flexible material to permit movement of the washbasin.

The subject invention further contemplates a force reservoir for counterbalancing the weight of the washbasin.

As shown in FIGS. 1 and 2, shaft 7 is affixed to the end of the upper arm 2 and a cylinder spring 6 surrounds the shaft. The spring is pre-loaded to counteract the weight of the washbasin. In the alternative, a gas pressure spring including an arresting element interposed between the wall and the washbasin can be used to counter-balance the weight of the washbasin and to arrest the washbasin at a desired height.

In operation of the embodiment disclosed in FIGS. 1 and 2, lever 5*a* is pivoted so that latch 5*b* disengages from latch wheel 5*c*. The washbasin 1 and its downward extension 4 can now be vertically adjusted because the arms 2 can be pivoted about piece 3 affixed to the wall. When the desired height of the washbasin is obtained, the lever 5*a* is pivoted so that the latch 5*b* engages the latch wheel 5*c* to secure the washbasin in the desired position.

In the preferred embodiment, the supporting arms 2 can be pivoted so that the angle of the arms in their respective upper and lower positions is between 35° and 50° with respect to the vertical. It is preferrable that the total range of the pivoting region of the supporting arms does not exceed 100°. In its lowest position, the washbasin can rest on a floor, and in its highest position, the washbasin can rest against the stationary piece 3 or the wall.

FIG. 2 of the drawings also illustrates a second pair of supporting arms 2, which like the first pair of supporting arms, are arranged in the vertically extending symmetry plane of the washbasin. The second pair of arms 2 are arranged horizontally next to the first pair of arms. As seen in FIG. 2, the cylinder spring 7 is connected at one of its ends to the upper arm of the first pair of supporting arms and at its other end to the upper arm of the second pair of arms.

I claim:

1. A height-adjustable washbasin including:

a washbasin having an upper portion and a downwardly extending portion;

a first supporting arm pivotally mounted to a stationary surface at one end and received by said downwardly extending portion of said washbasin at its other end;

a second supporting arm of equal length to said first supporting arm above and parallel to said first support arm mounted to said stationary surface at one end and received by said downwardly extending portion of said washbasin at its other end;

means enabling said washbasin to be arrested at different heights;

and a force reservoir counterbalancing the weight of said washbasin.

2. A washbasin as claimed in claim 1 wherein said means enabling said washbasin to be arrested at different heights includes:

a toothed latch wheel affixed to the end of one of said supporting arms received by said downwardly extending portion of said washbasin;

a lever pivotally mounted to said washbasin and having one of its ends received by said downwardly extending portion of said washbasin;

a latch affixed to said end of said lever received by said downwardly extending portion of said washbasin;

said lever being positioned so that said latch can be selectively pivoted into and out of engagement with said toothed latch wheel;

wherein when said latch engages said latch wheel, said supporting arm and said washbasin are arrested in position, and when said latch is disengaged from said latch wheel said supporting arm can be pivoted to adjust the height of said washbasin.

3. A washbasin as claimed in claim 1 wherein said first and second supporting arms are arranged in the vertically extending symmetry plane of said washbasin.

4. A washbasin as claimed in claim 1 wherein two further arms of the same kind, having the same orientation and with the same function as said first and second supporting arms are arranged horizontally next to said first arms, both pairs of arms being arranged symmetrically to the vertically orientated symmetry plane of said washbasin.

5. A washbasin as claimed in claim 1 wherein said force reservoir includes:

a gas pressure spring, which rests with its one end against said stationary surface and with its other end against said washbasin.

6. A washbasin as claimed in claim 1 wherein said force reservoir and said arresting means including:

a gas pressure spring, which rests with its one end against said stationary surface and with its other end against said washbasin;

said gas pressure spring having an arresting device, enabling said washbasin to be arrested at different heights.

7. A washbasin as claimed in claim 1 further including a shirt extending downwardly from said washbasin for covering parts beneath said washbasin.

8. A washbasin as claimed in claim 1 further including a flexible drain pipe and a flexible feed pipe connected to said washbasin.

9. A washbasin as claimed in claim 1 wherein in its upper end position said washbasin rests against a wall.

10. A washbasin as claimed in claim 1 wherein in its lower end position said washbasin rests on the floor.

11. A washbasin as claimed in claim 1 wherein said first and second supporting arms are sufficiently long so as to minimize horizontal movement of said washbasin when said first and second supporting arms are pivoted.

12. A washbasin as claimed in claim 1 wherein the pivoting range of said first and second supporting arms does not exceed 100°.

13. A washbasin as claimed in claim 1 wherein said force reservoir includes a pre-loaded cylinder spring which surrounds a shaft passing transversely through the ends of said two supporting arms orientated horizontally next to each other, one end of said spring being connected with the end of one of said supporting arms and the other end of said spring being connected with the other part transversely passed by that shaft.

14. A washbasin as claimed in claim 1 wherein the angle of said first and second supporting arms with respect to the vertical is between 35° and 50° when said supporting arms are in their respective upper and lower positions.

* * * * *

UNITED STATES PATENT AND TRADEMARK OFFICE

CERTIFICATE OF CORRECTION

PATENT NO. : 4,233,693

DATED : November 18, 1980

INVENTOR(S) : Peter Stocklow

It is certified that error appears in the above—identified patent and that said Letters Patent is hereby corrected as shown below:

Claim 13 is dependent from Claim 4.

Signed and Sealed this

*Tenth* Day of *February 1981*

[SEAL]

*Attest:*

RENE D. TEGTMEYER

*Attesting Officer*

*Acting Commissioner of Patents and Trademarks*